US006523199B2

(12) United States Patent
Gross

(10) Patent No.: US 6,523,199 B2
(45) Date of Patent: Feb. 25, 2003

(54) SELF ADJUSTING SUPPORT FOR SLEEPING

(76) Inventor: Raymond Noel Gross, 228 East St., EastHampton, MA (US) 01027

( * ) Notice: Subject to any disclaimer, the term of this patent is extended or adjusted under 35 U.S.C. 154(b) by 77 days.

(21) Appl. No.: 09/778,625

(22) Filed: Feb. 8, 2001

(65) Prior Publication Data

US 2002/0104165 A1 Aug. 8, 2002

(51) Int. Cl.[7] ..... A47C 20/00

(52) U.S. Cl. ..... 5/632; 5/640; 5/644; 5/652; 5/655.3

(58) Field of Search ..... 5/630, 632, 636, 5/640, 644, 731, 733, 652, 655.3

(56) References Cited

U.S. PATENT DOCUMENTS

| | | | | |
|---|---|---|---|---|
| 1,981,666 A | | 11/1934 | Ridley | |
| 2,700,779 A | | 2/1955 | Tolkowsky | |
| 2,782,427 A | | 2/1957 | Ericson | |
| 2,795,802 A | | 6/1957 | Myers | |
| 2,835,905 A | | 5/1958 | Tomasson | |
| 2,896,227 A | | 7/1959 | Reed | |
| 3,042,941 A | | 7/1962 | Marcus | |
| 3,382,510 A | | 5/1968 | Robinson | |
| 3,913,155 A | | 10/1975 | Eary, Sr. | |
| 3,946,452 A | | 3/1976 | Eary, Sr. | |
| 4,028,754 A | | 6/1977 | Eary, Sr. | |
| 4,405,129 A | * | 9/1983 | Stuckey | 482/112 |
| 4,688,283 A | * | 8/1987 | Jacobson et al. | 5/709 |
| 4,805,603 A | | 2/1989 | Cumberland | |
| 4,956,886 A | | 9/1990 | Sarkozi | |
| 5,020,174 A | | 6/1991 | SaRkozi | |
| 5,245,719 A | * | 9/1993 | Ott | 5/630 |
| 5,479,667 A | | 1/1996 | Nelson et al. | |
| 5,632,055 A | | 5/1997 | Graf | |
| 5,898,963 A | * | 5/1999 | Larson | 5/640 |

* cited by examiner

*Primary Examiner*—Michael F. Trettel
(74) *Attorney, Agent, or Firm*—Tod A. Myrum

(57) ABSTRACT

A support for aligning the head and torso. The support includes at least one first bladder containing a fluid. The first bladder is communicatively coupled to at least one second-bladder containing a fluid. When the user is in the side position atop the second bladder, at least a portion of the fluid in the second bladder is displaced into the first bladder by the user's torso. The fluid displaced into the first bladder causes the first bladder to raise the user's head when in the side position atop the first bladder.

49 Claims, 10 Drawing Sheets

SELF ADJUSTING SUPPORT FOR SLEEPING

BACKGROUND OF THE INVENTION

The present invention relates to improving comfort during sleep. More particularly, the present invention relates to an apparatus and a method for automatically maintaining the proper head and torso alignment when a user is sleeping in either the supine or side position and when the user rolls from the supine to the side position and vice versa.

Proper head and torso alignment while sleeping reduces muscle stress and spinal problems due to improper spinal alignment and improves circulation and respiration.

SUMMARY OF THE INVENTION

The above-mentioned problems associated with improper spinal alignment during sleep and other problems are addressed by the present invention. Embodiments of the present invention provide a support for aligning the head and torso. In one embodiment of the present invention, the support includes at least one first bladder containing a fluid. The first bladder is communicatively coupled to at least one second-bladder containing a fluid. When the user is, in the side position atop the second bladder, at least a portion of the fluid in the second bladder is displaced into the first bladder by the user's torso. The fluid displaced into the first bladder causes the first bladder to raise the user's head when in the side position atop the first bladder.

In another embodiment, the support includes at least one bladder containing a fluid. The bladder has first and second compartments that are communicatively coupled. When the user is in the side position atop the bladder, at least a portion of the fluid in the second compartment is displaced into the first compartment by the user's torso. The fluid displaced into the first compartment causes it to raise the user's head when in the side position atop the bladder.

DESCRIPTION OF THE INVENTION

Figure 1:
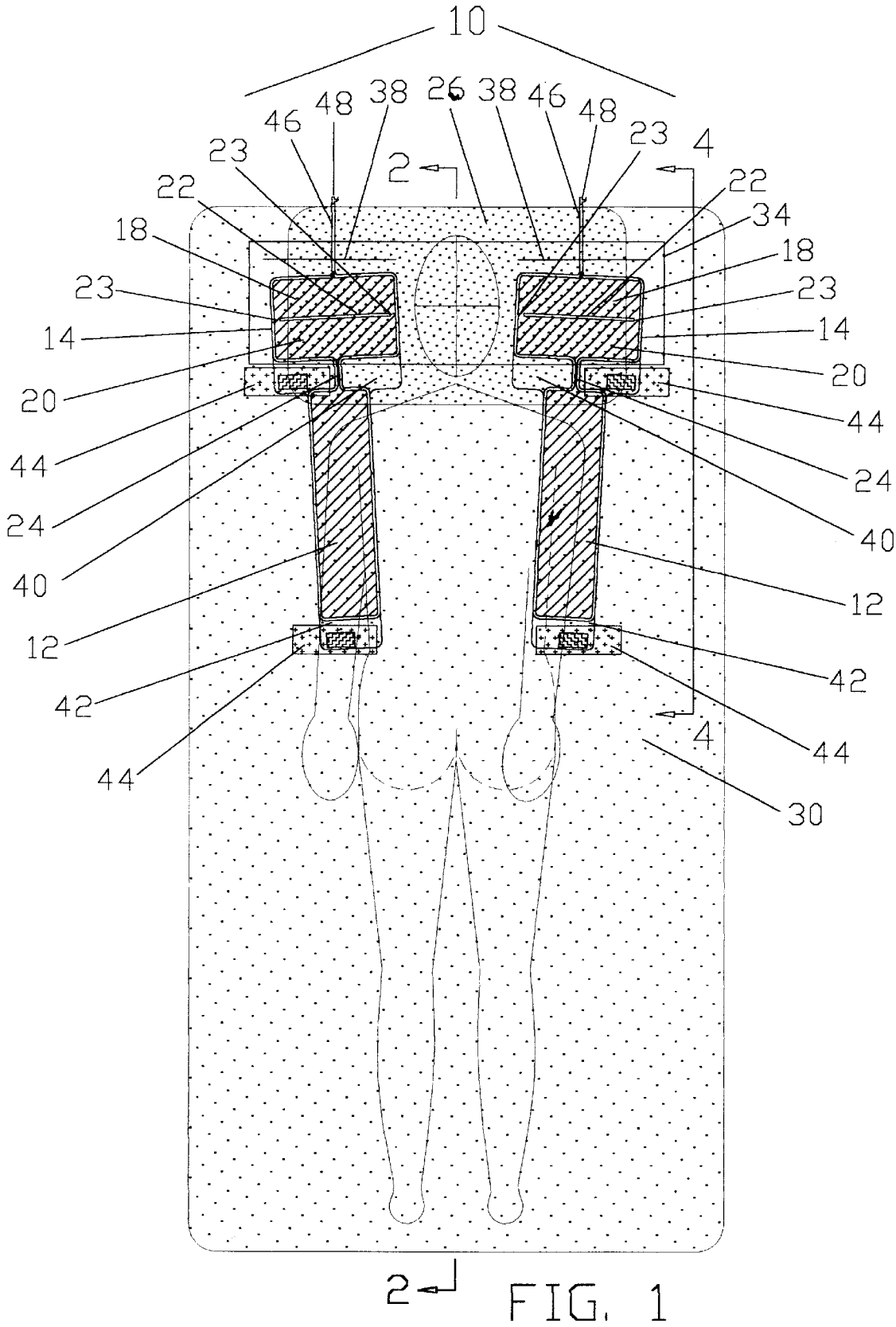
FIG. 1 is a top view of a first embodiment of the invention as used for sleeping in the supine position.

The present invention includes a support for aligning the head and torso. A first embodiment of the present invention is apparatus 10, demonstrated in FIGS. 1–6. Apparatus 10 includes a pair of identical bladders 12, 12, each containing a fluid, and a pair of identical bladders 14, 14, each containing a fluid, that are communicatively coupled to bladders 12, 12, respectively, to form a pair of identical bladder systems. The fluid contained in bladders 12, 12 and bladders 14, 14 is air. In another embodiment, the fluid is water.

Bladders 12, 12 may be of any suitable material having suitable strength and resilience properties, such as rubber or plastic. Bladders 12, 12 have cylindrical cross-sections. In another embodiment, each of bladders 12, 12 are sheathed in its own suitably resilient material for altering its cross-sectional shape and resilience properties. The respective longitudinal axes of bladders 12, 12 form an acute angle relative to the user's spinal column when the user is in the supine position, as demonstrated in FIG. 1. In another embodiment, the respective longitudinal axes form an obtuse angle relative to the user's spinal column when the user is in the supine position. In another embodiment, the respective longitudinal axes are parallel to the user's spinal column when the user is in the supine position.

Bladders 14, 14 may be of any suitable material having suitable strength and resilience properties, such as rubber or plastic. Bladders 14, 14 have cylindrical cross-sections. In another embodiment, each of bladders 14, 14 is sheathed in its own suitably resilient material for altering its cross-sectional shape and resilience properties. The respective longitudinal axes of bladders 14, 14 are perpendicular to those of bladders 12, 12, as demonstrated in FIGS. 1 and 5. In another embodiment, the respective longitudinal axes of bladders 14, 14 form an angle with respect to those of bladders 12, 12.

Each of bladders 14, 14 is divided into chambers 18 and 20, as demonstrated in FIGS. 1, 4, 5, and 6. Chambers 18 and 20 may be created using stitch 22, or a suitable equivalent, and may communicate with each other using baffles 23, as demonstrated in FIGS. 1 and 5. In another embodiment, chambers 18 and 20 communicate using a duct that couples them together. Chambers 18 and 20 provide cranium and chin support, respectively, when the user is in the side position. In another embodiment, each of bladders 14, 14 is a single chamber.

Apparatus 10 includes a pair of identical ducts 24, 24. Each of the ducts 24, 24 couples one of bladders 12, 12 to one of bladders 14, 14 for bi-directional fluid flow therebetween, as demonstrated in FIGS. 1, 4, 5 and 6. Ducts 24, 24 may be of any suitable material, such as plastic or rubber. Each duct 24, 24 may be attached to the respective bladders using any suitable means.

Figure 5:
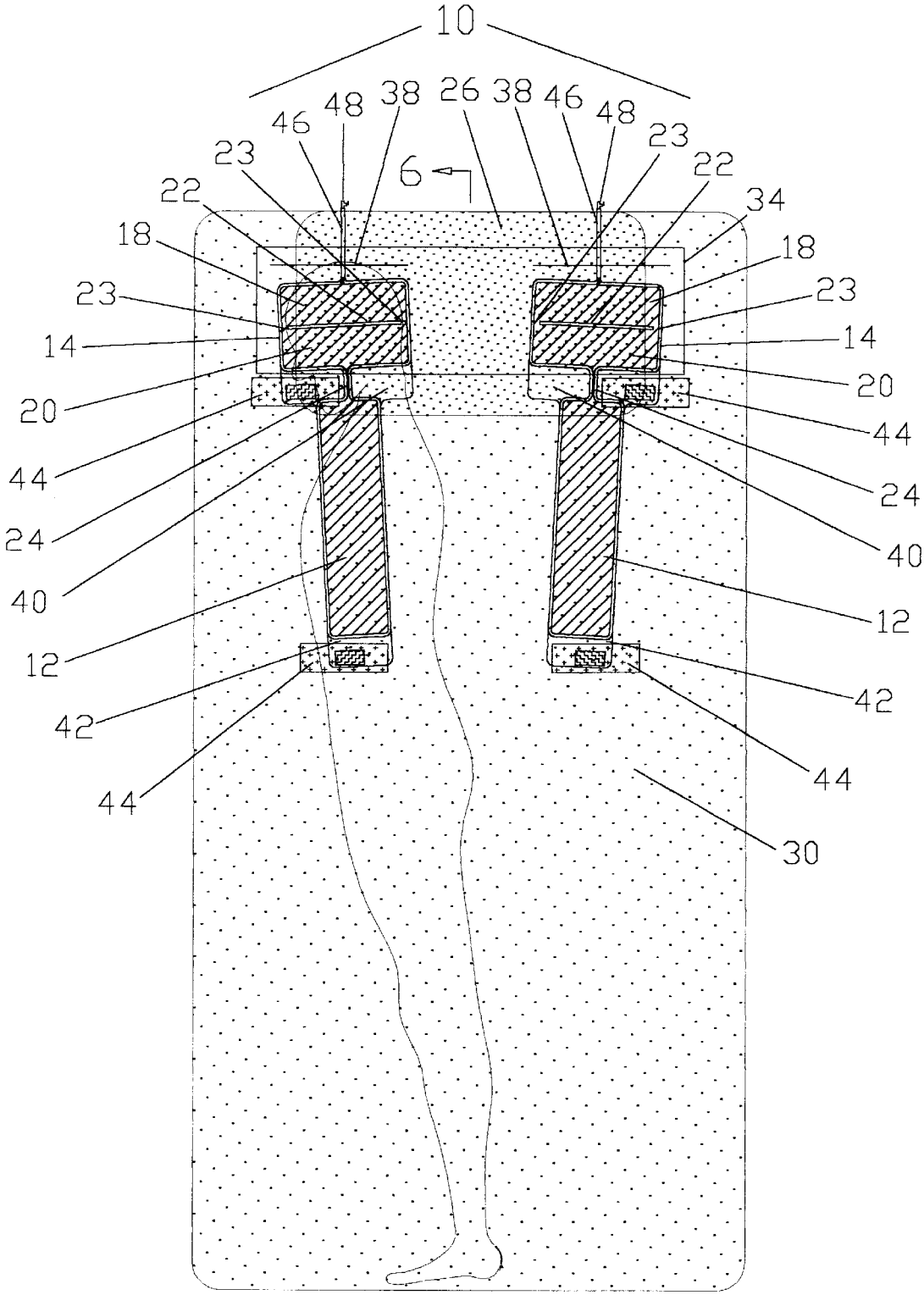
FIG. 5 is a top view of the first embodiment as used for sleeping in the side position.
Figure 6:
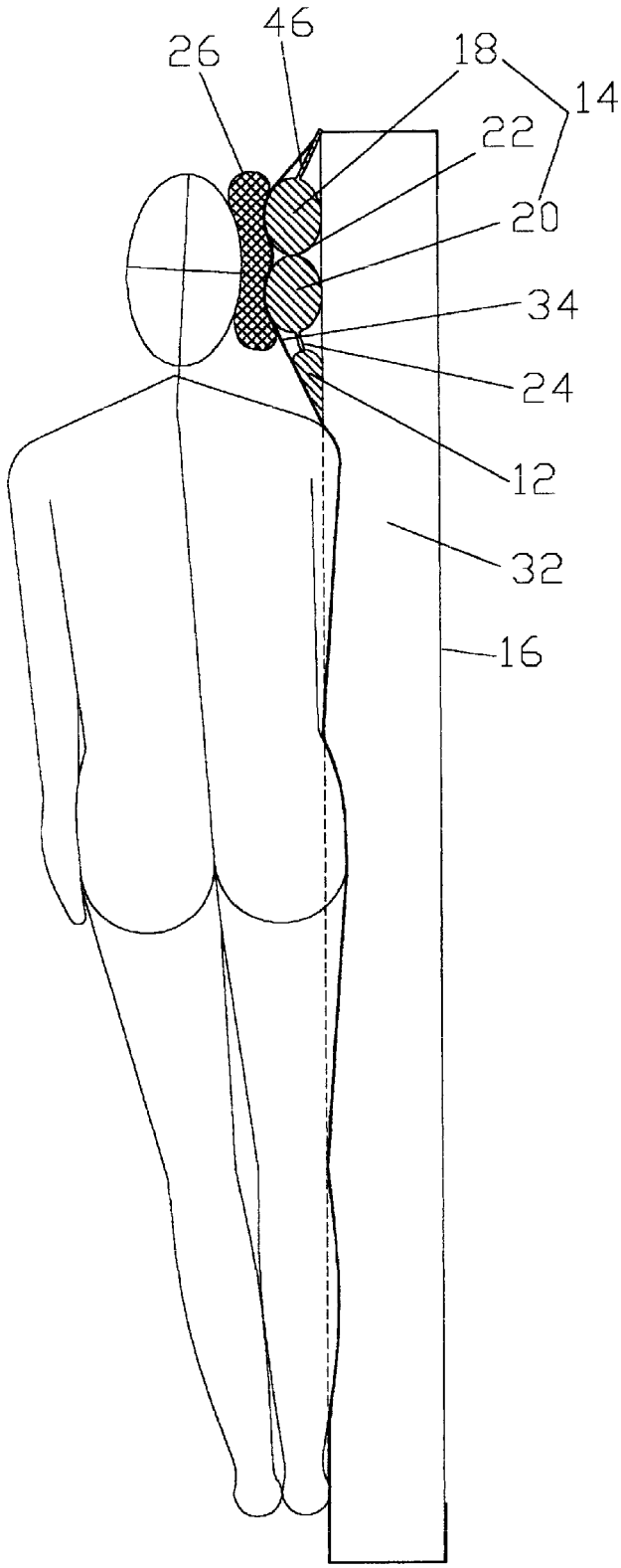
FIG. 6 is a side view of the first embodiment taken along line 6—6 of FIG. 5.

The fluid in either of bladders 12, 12 is displaced into the respective bladder 14 via the respective duct 24 by the user's torso when in a side position atop the respective bladder 12 (see FIGS. 5 and 6). The fluid displaced into the respective bladder 14 expands the respective bladder 14, causing that bladder to raise the head, as demonstrated in FIG. 6. Bladders 12, 12 and bladders 14, 14 are sized so that when the side of the torso is on either of bladders 12, 12, the respective bladder 12 is completely deflated, as demonstrated in FIG. 6. In another embodiment, bladders 12, 12 and bladders 14, 14 are sized so that when side of the torso is on either of bladders 12, 12, a portion of the fluid contained in the respective bladder 12 is displaced into the respective bladder 14.

Pillow 26 is used to provide additional support and head and torso alignment, in either the supine or side positions. Pillow 26 is positioned on bladders 14, 14, as demonstrated in FIGS. 2, 4, and 6, so that the pillow spans bladders 14, 14, as demonstrated in FIGS. 1 and 5. In another embodiment, pillow 26 is not used.

Figure 4:
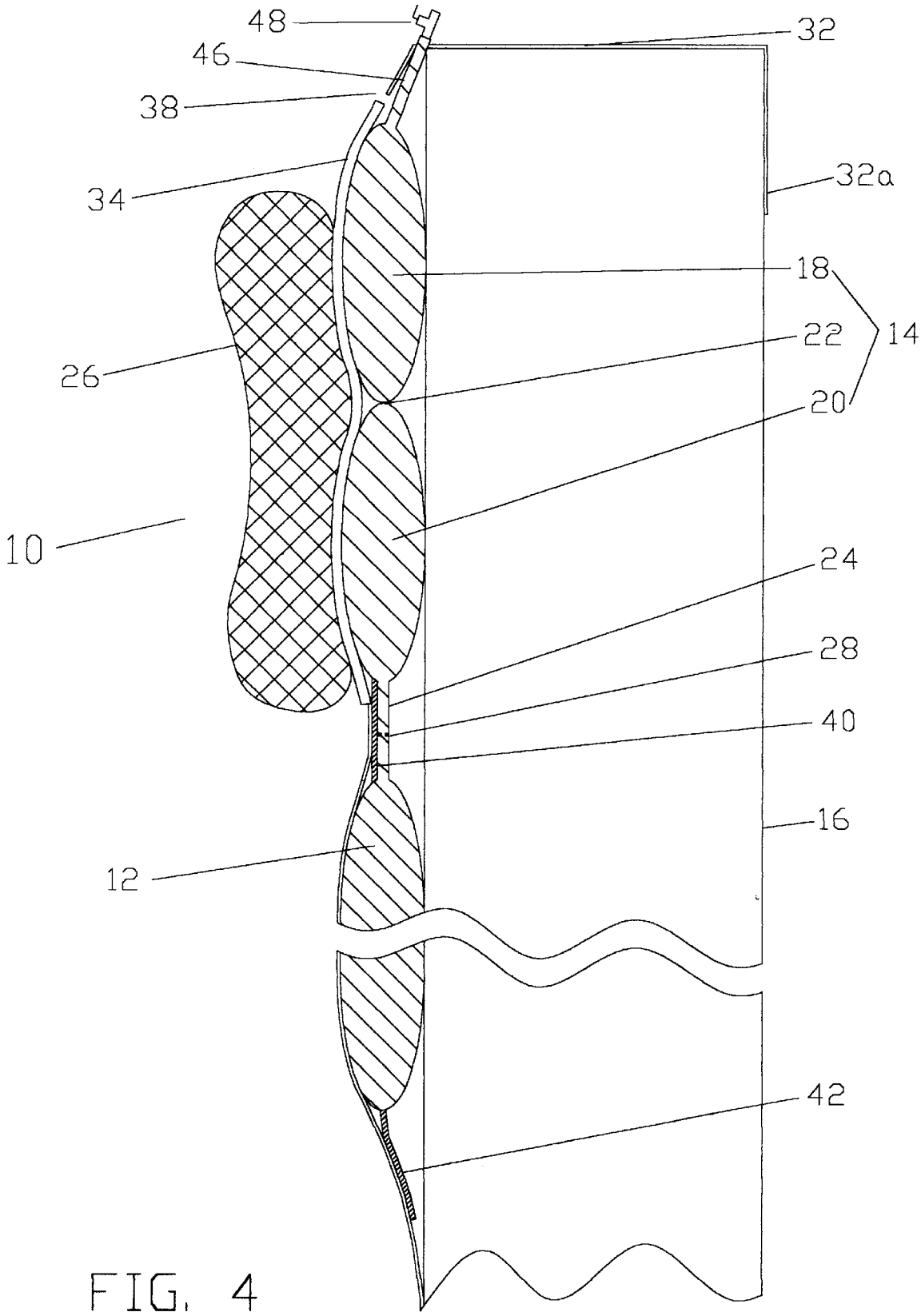
FIG. 4 is a side view of the first embodiment taken along line 4—4 of FIG. 1.

Apparatus 10 includes a pair of identical orifices 28, 28, each positioned in one of the ducts 24, 24, as demonstrated in FIG. 4. Orifices 28, 28 restrict the fluid flow through ducts 24, 24, respectively. Orifices 28, 28 may be sized so that either of the bladders 14, 14 raises the user's head at a sufficiently slow rate when the torso displaces the fluid from the respective bladder 12 into the respective bladder 14. The sizing of orifices 28, 28 also provides flow damping to prevent extraneous flow, resulting in undesirable inflation and deflation, when the user shifts during single-position sleep, i.e., either the supine or side positions. In another embodiment, orifices 28, 28 are replaced by a valve that either restricts the fluid flow in respective ducts 24, 24 or closes respective ducts 24, 24 to isolate respective bladders 12, 12 from respective bladders 14, 14.

Figure 3:
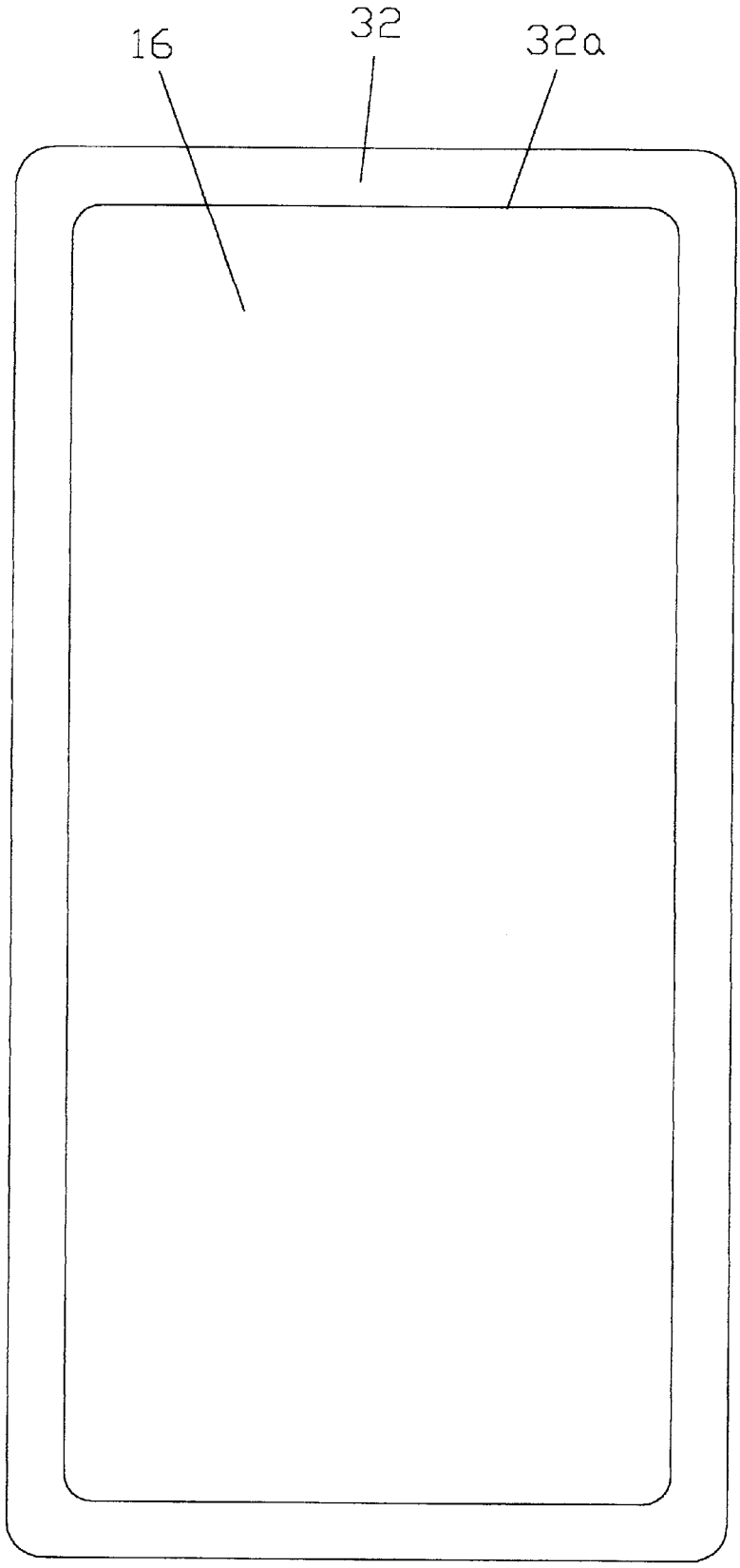
FIG. 3 is a bottom view of the first embodiment.

Apparatus 10 is disposed on mattress cover 30, as demonstrated in FIG. 1, that is secured to mattress 16 using apron 32 having elastic edge 32*a*, as demonstrated in FIG. 3. Alternatively, mattress cover 30 may be secured to mattress 16 using hook-and-loop material, such as VELCRO, metal or plastic clasp rings or clamps, or slings. Mattress cover 30 may be cloth, canvas, nylon, or other suitable mattress covering material. In one embodiment, mattress cover 30 is a mattress pad.

Apparatus 10 includes resilient material 34 that bears against each of bladders 14, 14 and conforms to its instantaneous shape, as demonstrated in FIGS. 1, 4, 5, and 6. Resilient material 34 is attached to mattress cover 30 to form a resilient pad that is positioned over bladders 14, 14, as shown. Resilient material 34 may be an elastic strip stretched over bladders 14, 14, however. Resilient material 34 may be fixedly attached to mattress pad 30 using glue, stitches, double-sided tape, or the like or selectively attached using hook-and-loop material, such as VELCRO. Whether resilient material 34 is fixedly or selectively attached to mattress cover 30, it may include slits 38, 38 as shown in FIGS. 1 and 4, to alter its resiliency.

Apparatus 10 includes a pair of identical tabs 40, 40 adapted to attaching the respective bladder-systems to mattress cover 30. Apparatus 10 includes a pair of identical tabs 42, 42 for attaching the respective bladders 12, 12 to mattress cover 30. As demonstrated in FIGS. 1, 4, and 5, each of tabs 40, 40 interconnects each of bladders 12, 12 to each of bladders 14, 14 and extends between adjacent portions of bladders 14, 14 and bladders 12, 12. Tabs 42, 42 extend from the respective bladders 12, 12 at a distal location, as shown in FIGS. 1, 4, and 5.

Bladders 12, 12 and bladders 14, 14 are selectively attached to mattress cover 30 using hook-and-loop material (44), such as VELCRO, to selectively attach tabs 40, 40 and 42, 42 to mattress cover 30, as shown in FIGS. 1 and 5. Selective attachment of bladders 12, 12 and bladders 14, 14 to mattress cover 30 enables selective positioning of bladders 12, 12 and bladders 14, 14 relative to mattress cover 30.

In another embodiment, bladders 12, 12 and bladders 14, 14 are fixedly attached to mattress cover 30 using glue, double-sided tape, stitches or the like to fixedly attach tabs 40, 40 and 42, 42 to mattress cover 30. In another embodiment, tabs 40, 40 and 42, 42 are eliminated and bladders 12, 12 and bladders 14, 14 are selectively attached directly to mattress cover 30 using hook-and-loop material, such as VELCRO. In another embodiment, tabs 40, 40 and 42, 42 are eliminated and bladders 12, 12 and bladders 14, 14 are fixedly attached directly to mattress cover 30 using glue, double-sided tape, or the like.

In another embodiment, bladders 12, 12 and bladders 14, 14 are sheathed in pockets on mattress cover 30. The pockets may be formed on mattress cover 30 by stitching or gluing a suitable material to mattress cover 30. Alternatively, the material may be attached to mattress cover 30 using hook-and-loop material, such as VELCRO.

Apparatus 10 has an identical pair of ducts 46, 46. Each of ducts 46, 46 is connected to chambers 18, 18 of the bladders 14, 14, respectively, as shown in FIGS. 1, 4, 5, and 6. Ducts 46, 46 may be of any suitable material, such as a suitable plastic or rubber. Each of ducts 46, 46 is connected to chambers 18, 18, respectively, using any suitable means. Each of ducts 46, 46 includes valves 48, 48, respectively, for selectively sealing it. Valves 48, 48 may include ball, Schrader, plug, pinch, or cap valves or the like. Each bladder system is individually inflated using one of the ducts 46, 46. In another embodiment, each of ducts 46, 46 is connected to chambers 20, 20, respectively. In another embodiment, each of ducts 46, 46 is connected to bladders 12, 12, respectively.

In another embodiment, ducts 46, 46 are coupled to single inlet duct. The inlet duct has valve 48, and one of ducts 46, 46 includes a valve that isolates the respective bladder systems during use. In this embodiment, the bladder systems are inflated simultaneously by means of the inlet duct. Inflation may be accomplished using a hand, a foot, or an electrically powered pump or by mouth.

In using apparatus 10, the pair of bladder systems, each including one of bladders 14, 14 communicatively coupled to one of bladders 12, 12 is disposed on mattress covering 30, as described above, that is affixed to mattress 16, as described above. In one, embodiment the pair of bladder systems is disposed on the floor. In another embodiment, the pair of bladder systems is disposed directly on a mattress. The user lies on mattress cover 30 in the supine position so that one of bladders 14, 14 is adjacent each side of the head, respectively, and one of bladders 12, 12 is adjacent each side of the torso, respectively. The respective bladder systems are then positioned so that in the supine position, each of the user's shoulders and arms rest atop each of bladders 12, 12, respectively, and the user's head lies between bladders 14, 14, as shown in FIG. 1. In another embodiment, the respective bladder systems are positioned so that in the supine position, each of the user's shoulders and arms rest atop each of bladders 12, 12, respectively, and the user's head lies on both of bladders 14, 14 simultaneously. Pillow 26 is positioned on bladders 14, 14 and used to support the user's head. In one embodiment pillow 26 is omitted. In another embodiment, bladders 12, 12 straddle the user's shoulders and arms in the supine position.

Figure 2:
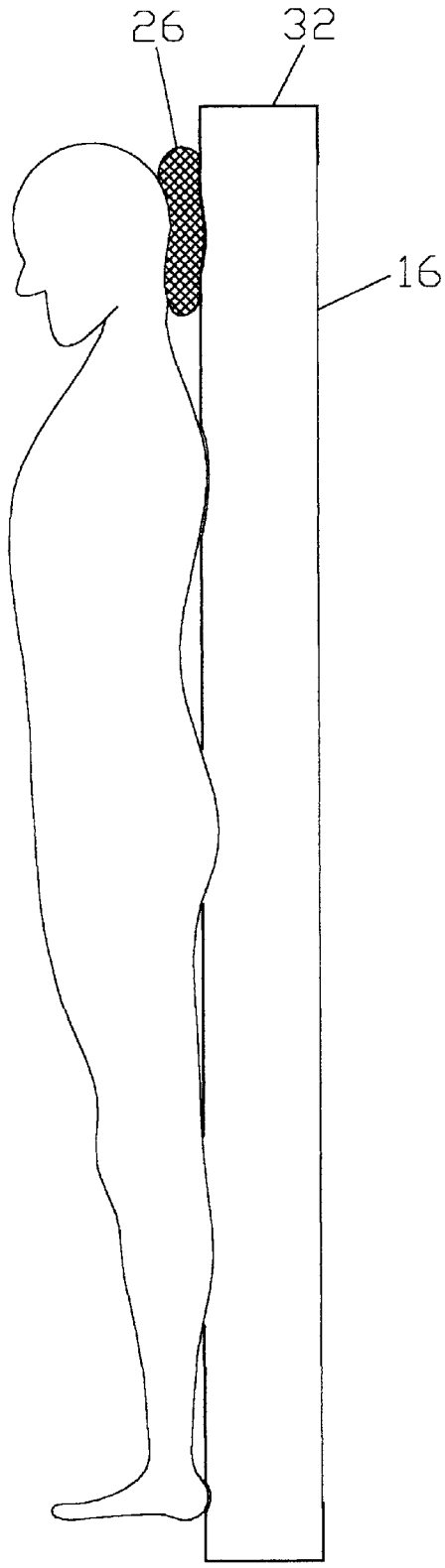
FIG. 2 is a side view of the first embodiment taken along line 2—2 of FIG. 1.

When the user rolls from the supine to the side position, the torso is positioned atop either of bladders 12, 12, as shown in FIG. 2. This displaces the fluid from the respective bladder 12 into the respective bladder 14 via the respective tube 24, causing the respective bladder 14 to expand, thus elevating the user's head.

Figure 7:
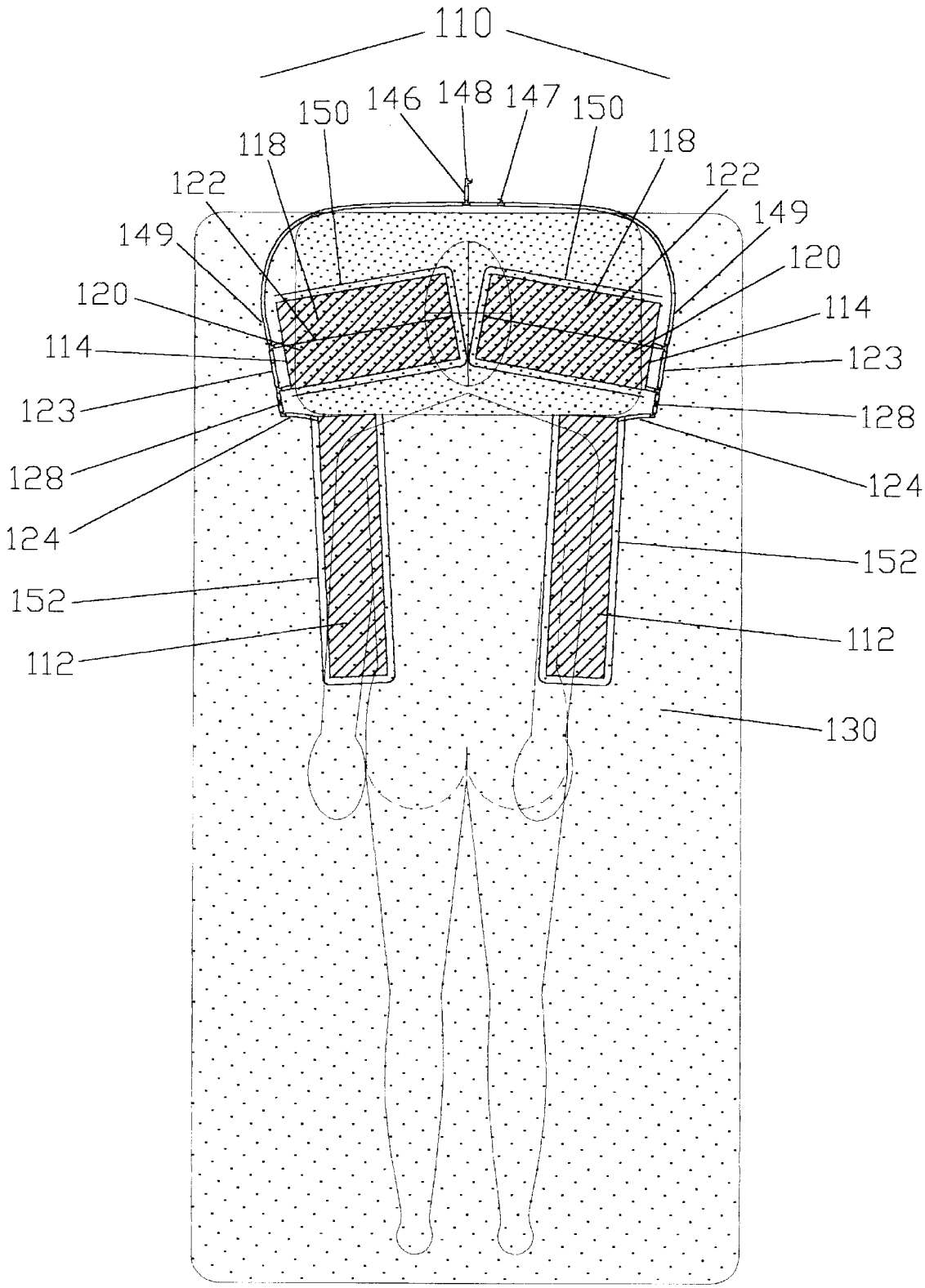
FIG. 7 is a top view of a second embodiment of the invention as used for sleeping in the supine position.

A second embodiment of the present invention is apparatus 110, exemplified in FIG. 7. Apparatus 110 includes a pair of identical bladders 112, 112, each containing a fluid, and a pair of identical bladders 114, 114, each containing a fluid, that are communicatively coupled to bladders 112, 112, respectively, to form a pair of identical bladder systems. The fluid contained in bladders 112, 112 and bladders 114, 114 is air. In another embodiment, the fluid is water.

Bladders 112, 112 may be of any suitable material having suitable strength and resilience properties, such as rubber or plastic. Bladders 112, 112 have cylindrical cross-sections. In another embodiment, each of bladders 112, 112 is sheathed in its own suitably resilient material for altering its cross-sectional shape and resilience properties. The respective longitudinal axes of bladders 112, 112 form an acute angle relative to the user's spinal column when the user is in the supine position, as demonstrated in FIG. 7. In another embodiment, the respective longitudinal axes form an obtuse angle relative to the user's spinal column when the user is in the supine position. In another embodiment, the respective longitudinal axes are parallel to the user's spinal column when the user is in the supine position.

Bladders 114, 114 may be of any suitable material having suitable strength and resilience properties, such as rubber or plastic. Bladders 114, 114 have cylindrical cross-sections. In another embodiment, each of bladders 114, 114 is sheathed in its own suitably resilient material for altering its cross-sectional shape and resilience properties. The respective longitudinal axes of bladders 114, 114 form an obtuse angle with respect to those of bladders 112, 112, as measured in the counter-clockwise direction, as shown in FIG. 7.

Each of bladders 114, 114 are divided into chambers 118 and 120, as demonstrated in FIG. 7. Chambers 118 and 120 may be created using stitch 122, or a suitable equivalent. Chambers 118 and 120 communicate using duct 123 that couples them together. Duct 123 may be of any suitable material, such as a suitable plastic or rubber. Duct 123 may be attached to chambers 118 and 120 by any suitable means. Chambers 118 and 120 provide cranium and chin support, respectively, when the user is in the side position. In another embodiment, each of bladders 114, 114 is a single chamber.

Apparatus 110 includes a pair of identical ducts 124, 124. Each of the ducts 124, 124 couples one of bladders 112, 112 to one of bladders 114, 114 for bi-directional fluid flow therebetween, as demonstrated in FIG. 7. Ducts 124, 124 may be of any suitable material, such as plastic or rubber. Each duct 124, 124 may be attached to the respective bladders using any suitable means.

The fluid in either of bladders 112, 112 is displaced into the respective bladder 114 via the respective duct 124 by the user's torso when in a side position atop the respective bladder 112. The fluid displaced into the respective bladder 114 expands the respective bladders 114, causing that bladder to raise the head. Bladders 112, 112 and bladders 114, 114 are sized so that when the side of the torso is on either of bladders 112, 112, the respective bladder 112 is completely deflated. In another embodiment, bladders 112, 112 and bladders 114, 114 are sized so that when the side of the torso is on either of bladders 112, 112, a portion of the fluid contained in the respective bladder 112 is displaced into the respective bladder 114.

Apparatus 110 includes a pair of identical orifices 128, 128, each positioned in one of the ducts 124, 124, as demonstrated in FIG. 7. Orifices 128, 128 restrict the fluid flow through ducts 124, 124, respectively. Orifices 128, 128 may be sized so that either of the bladders 114, 114 raises the user's head at a sufficiently slow rate when the torso displaces the fluid from the respective bladder 112 into the respective bladder 114. The sizing of orifices 128, 128 also provides flow damping to prevent extraneous flow, resulting in undesirable inflation and deflation, when the user shifts during single-position sleep, i.e., either the supine or side positions. In another embodiment, a valve that either restricts the fluid flow in respective ducts 124, 124 or closes respective ducts 124, 124, isolating respective bladders 112, 112 from respective bladders 114, 114 replaces orifices 128, 128.

Apparatus 110 is disposed on mattress cover 130, as demonstrated in FIG. 7, that is secured to a mattress using an apron having an elastic edge. Alternatively, mattress cover 130 may be secured to the mattress using hook-and-loop material, such as VELCRO, metal or plastic clasp rings or clamps, or slings. Mattress cover 130 may be cloth, canvas, nylon, or other suitable mattress covering material. In one embodiment, mattress cover 130 is a mattress pad.

Each of bladders 114, 114 may be attached to mattress pad 130 using one of the identical pockets 150, 150, shown in FIG. 7. Pockets 150, 150 may be formed on mattress pad 130 by stitching or gluing a covering of a suitable material to mattress pad 130. Each of bladders 112, 112 may be attached to mattress pad 130 using one of the identical pockets 152, 152 shown in FIG. 7. Pockets 152, 152 may be formed on mattress pad 130 by stitching or gluing a covering of a suitable material to mattress pad 130. Pockets 150, 150 and 152, 152 may be formed from any suitable covering of any suitable material that ensures that the covering instantaneously conforms to the respective bladders. Alternatively, pockets 150, 150 and 152, 152 may be attached to mattress pad 130 using hook-and-loop material, such as VELCRO. In one embodiment, the interior of pockets 152, 152 may converge in going from the top of the pockets, adjacent bladders 114, 114 to the bottom of the pocket, enabling bladders 112, 112 to be tapered.

Apparatus 110 has duct 146 that may be of any suitable material, such as a suitable plastic or rubber. As seen in FIG. 7, duct 146 is common to both bladder systems and serves as a manifold dividing into two outlets (149, 149). The respective outlets 149, 149 are connected to each of ducts 123, 123, each feeding chambers 118 and 120 of the respective bladders 114, 114 and leading into one of the tubes 124, 124 each containing one of the orifices 128, 128. Duct 146 may selectively sealed using valve 148. Valve 148 may include ball, Schrader, plug, pinch, or cap valves or the like. Outlets 149, 149 may be selectively isolated from each other using an appropriate valve 147. Inlet 146 and outlets 149, 149 may be of any suitable material, such as a suitable plastic or rubber. The bladder systems are inflated simultaneously by means of duct 146. Inflation of the respective bladder systems may be accomplished using a hand, a foot, or an electrically powered pump or by mouth.

In using apparatus 10, the pair of bladder systems, each including one of bladders 114, 114 communicatively coupled to one of bladders 112, 112 is disposed on mattress covering 130, as described above, that is affixed to a mattress, as described above. The user lies on mattress cover 130 in the supine position so that one of bladders 114, 114 is adjacent each side of the head, respectively, and one of bladders 112, 112 is adjacent each side of the torso, respectively. The respective bladder systems are then positioned so that in the supine position, each of the user's shoulders and arms rest atop each of bladders 112, 112, respectively, and the user's head lies on both of bladders 114, 114 simultaneously, as shown in FIG. 7. In another embodiment, the respective bladder systems are positioned so that in the supine position, each of the user's shoulders and arms rest atop each of bladders 112, 112, respectively, and the user's head lies between bladders 114, 114. In another embodiment, bladders 112, 112 straddle the user's shoulders and arms in the supine position.

When the user rolls from the supine to the side position, the torso is positioned atop either of bladders 112, 112. This displaces the fluid from the respective bladder 112 into the respective bladder 114 via the respective tube 124, causing the respective bladder 114 to expand, thus elevating the user's head.

Figure 8:
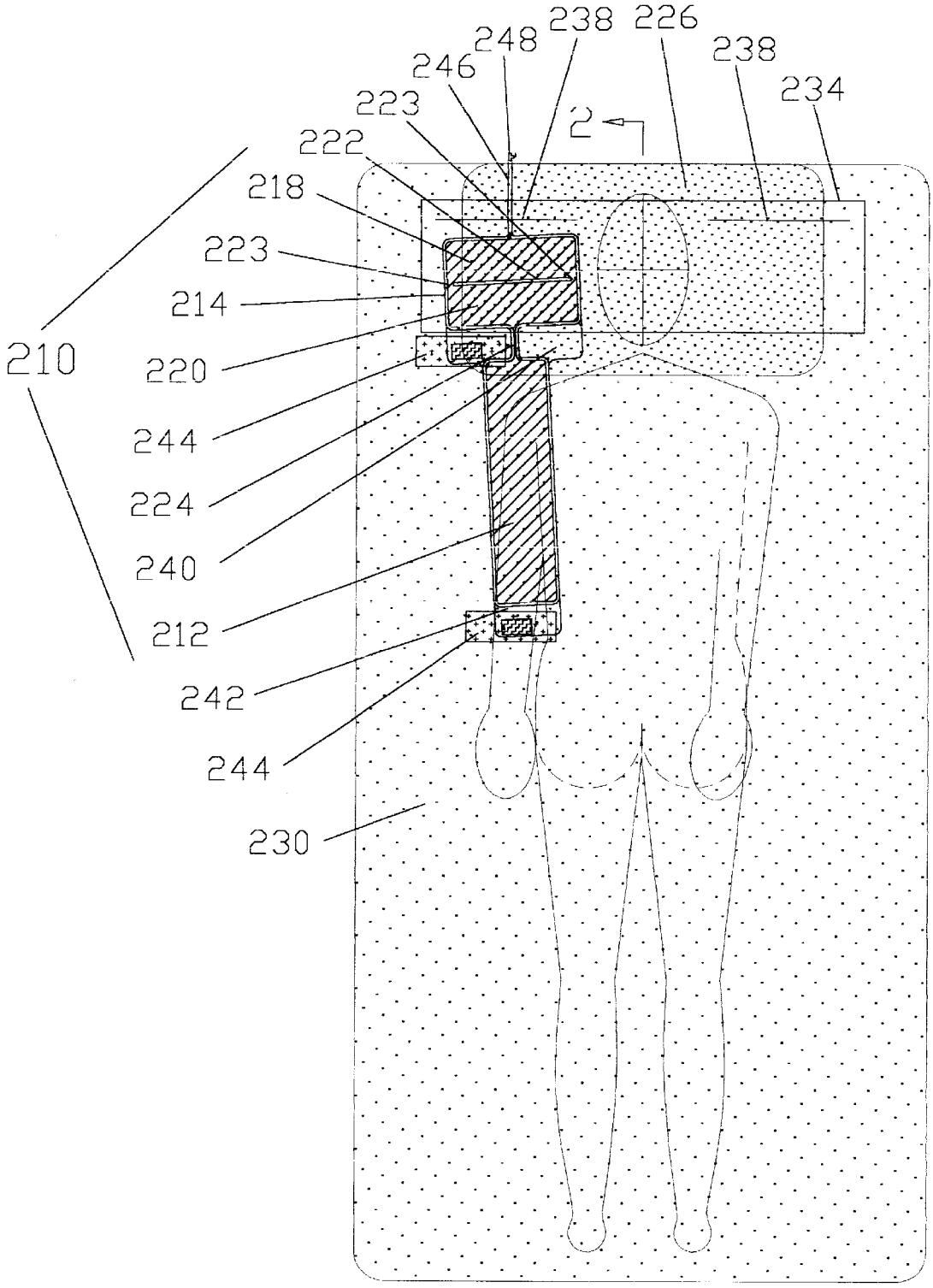
FIG. 8 is a top view of a third embodiment of the invention as used for sleeping in the supine position.

A third embodiment of the present invention is apparatus 210, demonstrated in FIG. 8. Apparatus 210 includes bladder 212 that contains a fluid and bladder 214 that contains a fluid and that is communicatively coupled to bladder 212. The fluid contained in bladders 212 and 214 is air. In another embodiment, the fluid is water.

Bladder 212 may be of any suitable material having suitable strength and resilience properties, such as rubber or plastic. Bladder 212 has a cylindrical cross-section. In another embodiment, bladder 212 is sheathed in its own suitably resilient material for altering its cross-sectional shape and resilience properties. The longitudinal axis of bladder 212 forms an acute angle relative to the user's spinal column when the user is in the supine position, as demonstrated in FIG. 8. In another embodiment, the longitudinal axis of bladder 212 forms an obtuse angle relative to the user's spinal column when the user is in the supine position. In another embodiment, the longitudinal axis of bladder 212 is parallel to the user's spinal column when the user is in the supine position.

Bladder 214 may be of any suitable material having suitable strength and resilience properties, such as rubber or plastic. Bladder 214 has a cylindrical cross-section. In another embodiment, bladder 214 is sheathed in its own suitably resilient material for altering its cross-sectional shape and resilience properties. The longitudinal axis of bladder 214 is perpendicular to that of bladder 212, as demonstrated in FIG. 8. In another embodiment, the longitudinal axis of bladder 214 forms an angle with respect to that of bladder 212.

Bladder 214 is divided into chambers 218 and 220, as demonstrated in FIG. 8. Chambers 218 and 220 may be created using stitch 222, or a suitable equivalent, and may communicate with each other using baffles 223, as demonstrated in FIG. 8. In another embodiment, chambers 218 and 220 communicate using a duct that couples them together. Chambers 218 and 220 provide cranium and chin support, respectively, when the user is in the side position. In another embodiment, bladder 214 is a single chamber.

Apparatus 210 includes a duct 224. Duct 224 couples bladder 212 to bladder 214 for bi-directional fluid flow therebetween, as demonstrated in FIG. 8. Duct 224 may be of any suitable material, such as plastic or rubber. Duct 224 may be attached to the respective bladders using any suitable means.

The fluid in bladder 212 is displaced into bladder 214 via duct 224 by the user's torso when in a side position atop bladder 212. The fluid displaced into the bladder 214 expands bladder 214, causing it to raise the head. Bladder 212 and bladder 214 are sized so that when the side of the torso is on bladder 212, it is completely deflated. In another embodiment, bladder 212 and bladder 214 are sized so that when the side of the torso is on bladder 212, a portion of the fluid therein is displaced into bladder 214.

Pillow 226 is used to provide additional support and head and torso alignment, in either the supine or side positions. Pillow 226 is positioned on bladder 214, as demonstrated in FIG. 8. In another embodiment, pillow 226 is not used.

Apparatus 210 includes an orifice (not shown) that is located in duct 224. The orifice restricts the fluid flow through duct 224. The orifice may be sized so that bladder 214 raises the user's head at a sufficiently slow rate when the torso displaces the fluid from bladder 212 into bladder 214. The sizing of the orifice also provides flow damping to prevent extraneous flow, resulting in undesirable inflation and deflation, when the user shifts while in a side position atop the bladder system.

Apparatus 210 is disposed on mattress cover 230, as demonstrated in FIG. 8, that is secured to a mattress using an apron having an elastic edge. Alternatively, mattress cover 230 may be secured to a mattress using hook-and-loop material, such as VELCRO, metal or plastic clasp rings or clamps, or slings. Mattress cover 230 may be cloth, canvas, nylon, or other suitable mattress covering material. In one embodiment, mattress cover 230 is a mattress pad.

Apparatus 210 includes resilient material 234 that bears against bladder 214 and conforms to its instantaneous shape, as demonstrated in FIG. 8. Resilient material 234 is attached to mattress cover 230 to form a resilient pad that is positioned over bladder 214, as shown. Resilient material 234 may be an elastic strip stretched over bladder 214, however. Resilient material 234 may be fixedly attached to mattress pad 230 using glue, stitches, double-sided tape, or the like or selectively attached using hook-and-loop material, such as VELCRO. Whether resilient material 234 is fixedly or selectively attached to mattress cover 230, it may include slits 238, 238 as shown in FIG. 8, to alter its resiliency.

Apparatus 210 includes tab 240 and tab 242. As demonstrated in FIG. 8, tab 240 interconnects bladder 212 to bladder 214.and extends between adjacent portions of bladder 214 and bladder 212. Tab 242 extends from the bladder 212 at a distal location, as shown in FIG. 8.

Bladder 212 and bladder 214 are selectively attached to mattress cover 230 using hook-and-loop material (244), such as VELCRO, to selectively attach tabs 240 and 242 to mattress cover 230, as shown in FIG. 8. Selective attachment of bladders 212 and 214 to mattress cover 230 enables selective positioning of bladders 212 and 214 relative to mattress cover 230.

In another embodiment, bladders 212 and 214 are fixedly attached to mattress cover 230 using glue, double-sided tape, stitches or the like to fixedly attach tabs 240 and 242 to mattress cover 230. In another embodiment, tabs 240 and 242 are eliminated and bladders 212 and 214 are selectively attached directly to mattress cover 230 using hook-and-loop material, such as VELCRO. In another embodiment, tabs 240 and 242 are eliminated and bladders 212 and 214 are fixedly attached directly to mattress cover 230 using glue, double-sided tape, or the like.

In another embodiment, bladders 212 and 214 are sheathed in pockets on mattress cover 230. The pockets may be formed on mattress cover 230 by stitching or gluing a suitable material to mattress 230. Alternatively, the material may be attached to mattress cover 230 using hook-and-loop material, such as VELCRO.

Apparatus 210 has duct 246. Duct 246 is connected to chamber 218 of the bladder 214, as shown in FIG. 8. Duct 246 may be of any suitable material, such as a suitable plastic or rubber. Duct 246 is connected to chamber 218 using any suitable means. Duct 246 includes valve 248 for selectively sealing it. Valve 248 may include ball, Schrader, plug, pinch, or cap valves or the like. Bladders 212 and 214 are inflated using duct 246. In one embodiment, duct 246 is connected to bladder 212. In another embodiment, duct 246 is connected to chamber 220. Inflation of bladders 212 and 214 may be accomplished using a hand, a foot, or an electrically powered pump or by mouth.

In using apparatus 210, a bladder system including bladder 214 communicatively coupled to bladder 212 is disposed on mattress covering 230, as described above, that is affixed to a mattress, as described above. In one, embodiment the bladder system is disposed on the floor. In another embodiment, the bladder system is disposed directly on a mattress. The user lies on mattress cover 230 in the supine position adjacent the bladder system, with bladder 214 adjacent the head and bladder 212 adjacent the torso. Pillow 226 is positioned on bladder 214 and used to support the user's head. In one embodiment pillow 226 is omitted. When the user rolls from the supine to the side position, the torso is positioned atop bladder 212. This displaces the fluid from bladder 212 into bladder 214 via respective tube 224, causing bladder 214 to expand, thus elevating the user's head.

A fourth embodiment of the present invention has at least one bladder that contains a fluid. The bladder is divided into two compartments that are communicatively coupled. Apparatus 310, shown in FIG. 9, demonstrates the fourth embodiment. Apparatus 310 includes a pair of identical bladders 311, 311, each containing a fluid. Each of bladders 311, 311 respectively includes compartments 312, 312. Each of bladders 311, 311 respectively includes compartments 314, 314 that are communicatively coupled to compartments 312, 312, respectively. The fluid contained in bladders 311, 311 is air. In another embodiment, the fluid is water.

Bladders 311, 311 may be of any suitable material having suitable strength and resilience properties, such as rubber or plastic. Bladders 311, 311 have cylindrical cross-sections. In another embodiment, each of bladders 311, 311 is sheathed in its own suitably resilient material for altering its cross-sectional shape and resilience properties. The respective longitudinal axes of bladders 311, 311 form an acute angle relative to the user's spinal column when the user is in the supine position, as demonstrated in FIG. 9. In another embodiment, the respective longitudinal axes form an obtuse angle relative to the user's spinal column when the user is in the supine position. In another embodiment, the respective longitudinal axes are parallel to the user's spinal column when the user is in the supine position.

The fluid in either of compartments 312, 312 is displaced into the respective compartment 314 by the user's torso when in a side position atop the respective bladder 311. The fluid displaced into the respective compartment 314 expands it, causing it raise the head. Compartments 312, 312 and compartments 314, 314 are sized so that when the side of the torso is on either of bladders 311, 311, the respective compartment 312 is completely deflated. In another embodiment, compartments 312, 312 and compartments 314, 314 are sized so that when the side of the torso is on either of bladders 311, 311, a portion of the fluid contained in the respective compartment 312 is displaced into the respective compartment 314.

Pillow 326 is used to provide additional support and head and torso alignment, in either the supine or side positions. Pillow 326 is positioned on compartments 314, 314, as demonstrated in FIG. 9, so that the pillow spans compartments 314, 314. In another embodiment, pillow 326 is not used.

Figure 9:
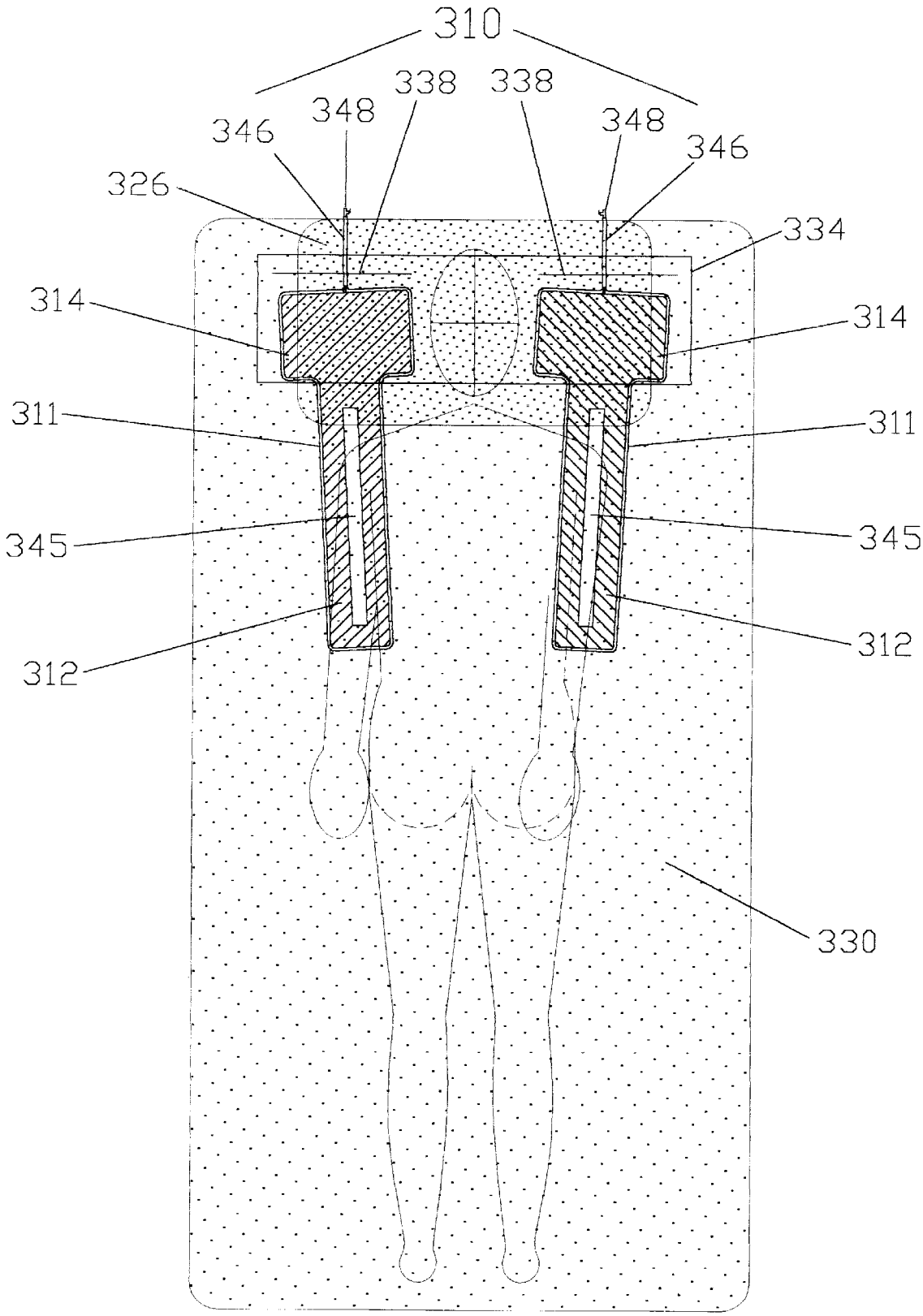
FIG. 9 is a top view of a fourth embodiment of the invention as used for sleeping in the supine position.

Apparatus 310 is disposed on mattress cover 330, as demonstrated in FIG. 9, that is secured to a mattress using an apron having an elastic edge. Alternatively, mattress cover 330 may be secured to a mattress using hook-and-loop material, such as VELCRO, metal or plastic clasp rings or clamps, or slings. Mattress cover 330 may be cloth, canvas, nylon, or any other suitable mattress covering material. In one embodiment, mattress cover 330 is a mattress pad.

Apparatus 310 includes resilient material 334 that bears against each of compartments 314, 314 of bladders 311, 311 and conforms to its instantaneous shape, as demonstrated in FIG. 9. Resilient material 334 is attached to mattress cover 330 to form a resilient pad that is positioned over compartments 314, 314, as shown. Resilient material 334 may be an elastic strip stretched over compartments 314, 314, however. Resilient material 334 may be fixedly attached to mattress pad 330 using glue, stitches, double-sided tape, or the like or selectively attached using hook-and-loop material, such as VELCRO. Whether resilient material 334 is fixedly or selectively attached to mattress cover 330, it may include slits 338, 338 as shown in FIG. 9, to alter its resiliency.

Each of bladders 311, 311 is secured to mattress cover 330 using double-sided tape 345, as shown in FIG. 9. In another embodiment, the double-sided tape is replaced by hook-and-loop material, such as VELCRO.

Apparatus 310 has an identical pair of ducts 346, 346. Each of ducts 346, 346 is connected to compartments 314, 314, respectively, as shown in FIG. 9. Ducts 346, 346 may be of any suitable material, such as a suitable plastic or rubber. Each of ducts 346, 346 is connected to compartments 314, 314, respectively, using any suitable means. Each of ducts 346, 346 includes valves 348, 348, respectively, for selectively sealing it. Valves 348, 348 may include ball, Schrader, plug, pinch, or cap valves or the like. Each of bladders 311, 311 is individually inflated using one of the ducts 346, 346. In another embodiment, each of ducts 346, 346 is connected to compartments 312, 312, respectively.

In another embodiment, ducts 346, 346 are coupled to single inlet duct. The inlet duct has valve 348, and one of ducts 346, 346 includes a valve that isolates the respective bladder systems during use. In this embodiment, the bladders 311, 311 are inflated simultaneously by means of the inlet duct. Inflation may be accomplished using a hand, a foot, or an electrically powered pump or by mouth.

In using apparatus 310, the bladders 311, 311 are disposed on mattress covering 330, as described above, that is affixed to a mattress, as described above. In one embodiment, bladders 311, 311 are disposed on the floor. In another embodiment, bladders 311, 311 are disposed directly on a mattress. The user lies on mattress cover 330 in the supine position so that one of compartments 314, 314 is adjacent each side of the head, respectively, and one of compartments 312, 312 is adjacent each side of the torso, respectively. In this position, each of the user's shoulders and arms rest atop each of compartments 312, 312, respectively, and the user's head lies between compartments 314, 314, as shown in FIG. 9. In another embodiment, bladders 311, 311 are positioned so that in the supine position, each of the user's shoulders and arms rest atop each of compartments 312, 312, respectively, and the user's head lies on both of compartments 314, 314 simultaneously. Pillow 326 is positioned on compartments 314, 314 and used to support the user's head. In one embodiment, pillow 326 is omitted. In another embodiment, compartments 312, 312 straddle the user's shoulders and arms in the supine position.

When the user rolls from the supine to the side position, the torso is positioned atop either of compartments 312, 312. This displaces the fluid from the respective compartment 312 into the respective compartment 314, causing the respective compartment 314 to expand, thus elevating the user's head.

Figure 10:
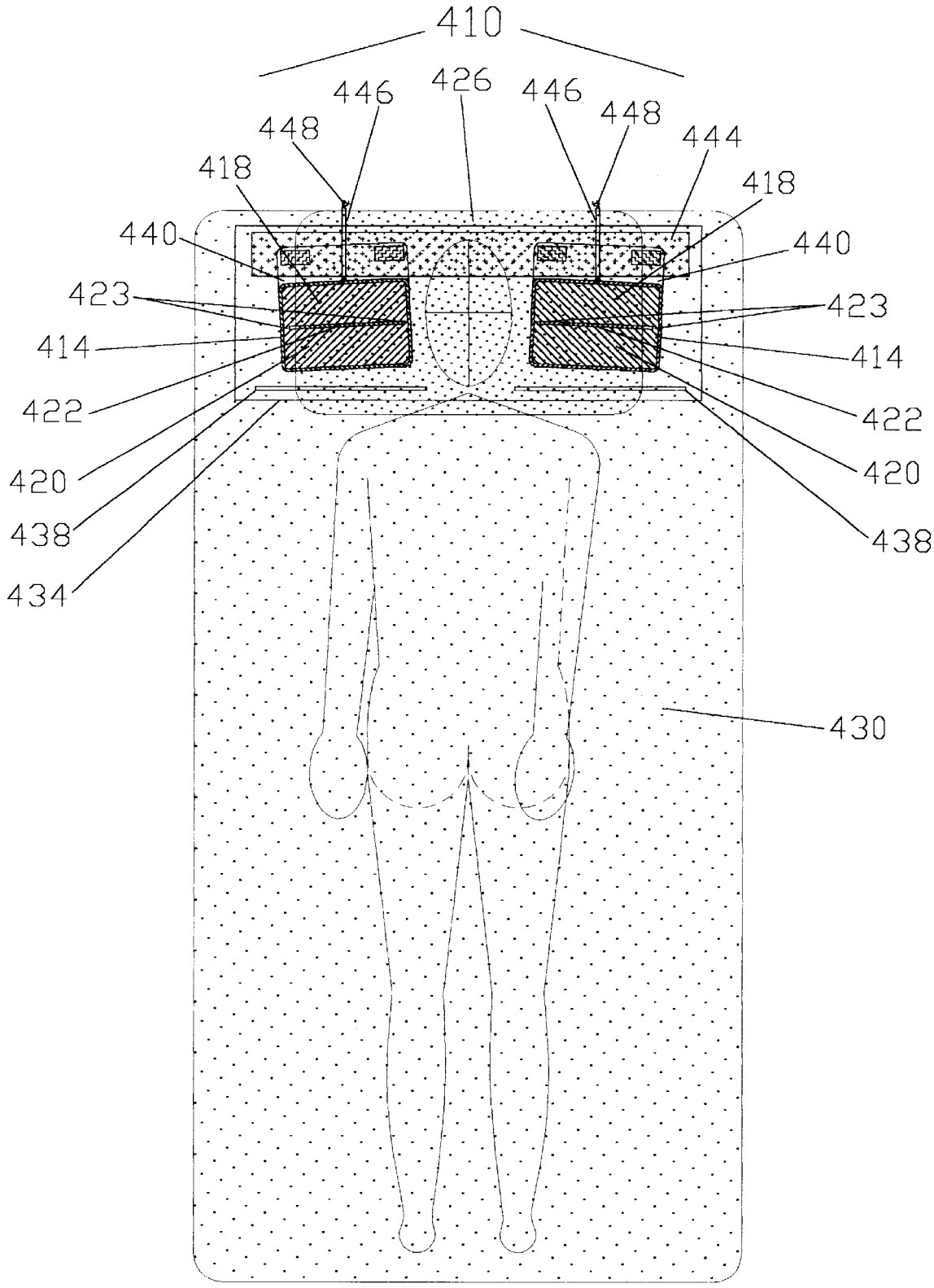
FIG. 10 is a top view of a fifth embodiment of the invention as used for sleeping in the supine position.

A fifth embodiment of the present invention is apparatus 410, demonstrated in FIG. 10. Apparatus 410 includes a pair of identical bladders 414, 414, each containing a fluid. The fluid contained in bladders 414, 414 is air. In another embodiment, the fluid is water.

Bladders 414, 414 may be of any suitable material having suitable strength and resilience properties, such as rubber or plastic. Bladders 414, 414 have cylindrical cross-sections. In another embodiment, each of bladders 414, 414 is sheathed in its own suitably resilient material for altering its cross-sectional shape and resilience properties. Each of bladders 414, 414 is divided into chambers 418 and 420, as demonstrated in FIG. 10. Chambers 418 and 420 may be created using stitch 422, or a suitable equivalent, and may communicate with each other using baffles 423, as demonstrated in FIG. 10. Chambers 418 and 420 provide cranium and chin support, respectively, when the user is in the side position.

Pillow 426 is used to provide additional support and head and torso alignment, in either the supine or side positions. Pillow 426 is positioned on bladders 414, 414, as demonstrated in FIG. 10, so that the pillow spans bladders 414, 414. In another embodiment, pillow 426 is not used.

Apparatus 410 is disposed on mattress cover 430, as demonstrated in FIG. 10, that is secured to a mattress using an apron having an elastic edge. Alternatively, mattress cover 430 may be secured to a mattress using hook-and-loop material, such as VELCRO, metal or plastic clasp rings or clamps, or slings. Mattress cover 430 may be cloth, canvas, nylon, or other suitable mattress covering material. In one embodiment, mattress cover 430 is a mattress pad.

Apparatus 410 includes resilient material 434 that bears against each of bladders 414, 414 and conforms to its instantaneous shape, as demonstrated in FIG. 10. Resilient material 434 is attached to mattress cover 430 to form a resilient pad that is positioned over bladders 414, 414, as shown. Resilient material 434 may be an elastic strip stretched over bladders 414, 414, however. Resilient material 434 may be fixedly attached to mattress pad 430 using glue, stitches, double-sided tape, or the like or selectively attached using hook-and-loop material, such as VELCRO. Whether resilient material 434 is fixedly or selectively attached to mattress cover 430, it may include slits 438, 438 as shown in FIG. 102, to alter its resiliency.

Apparatus 410 includes a pair of identical tabs 440, 440 adapted to attaching the respective bladders 414, 414 to mattress cover 430 ). Bladders 414, 414 are selectively attached to mattress cover 430 using hook-and-loop material (444), such as VELCRO, to selectively attach tabs 446, 440 to mattress cover 430, as shown in FIG. 10. Selective attachment of bladders 414, 414 to mattress cover 430 enables selective positioning of bladders 414, 414 relative to mattress cover 430. In another embodiment, bladders 414, 414 are fixedly attached to mattress cover 430 using glue, double-sided tape, stitches or the like to fixedly attach tabs 440, 440 to mattress cover 430. In another embodiment, tabs 440, 440 are eliminated and bladders 414, 414 are selectively attached directly to mattress cover 430 using hook-and-loop material, such as VELCRO. In another embodiment, tabs 440, 440 are eliminated and bladders 414, 414 are fixedly attached directly to mattress cover 430 using glue, double-sided tape, or the like.

In another embodiment, bladders 414, 414 are sheathed in pockets on mattress cover 430. The pockets may be formed on mattress cover 430 by stitching or gluing a suitable material to mattress 430. Alternatively, the material may be attached to mattress cover 430 using hook-and-loop material, such as VELCRO.

Apparatus 410 has an identical pair of ducts 446, 446. Each of ducts 446, 446 is connected to chambers 418, 418 of the bladders 414, 414, respectively, as shown in FIG. 10. Ducts 446, 446 may be of any suitable material, such as a suitable plastic or rubber. Each of ducts 446, 446 is connected to chambers 418, 418, respectively, using any suitable means. Each of ducts 446, 446 includes valves 448, 448, respectively, for selectively sealing it. Valves 448, 448 may include ball, Schrader, plug, pinch, or cap valves or the like. Each bladder system is individually inflated using one of the ducts 446, 446. In another embodiment, each of ducts 446, 446 is connected to chambers 420, 420, respectively.

In another embodiment, ducts 446, 446 are coupled to single inlet duct. The inlet duct has valve 448, and one of ducts 446, 446 includes a valve that isolates the respective bladder systems during use. In this embodiment, the bladder systems are inflated simultaneously by means of the inlet duct. Inflation may be accomplished using a hand, a foot, or an electrically powered pump or by mouth.

In using apparatus 410, the pair of bladders 414, 414 is disposed on mattress covering 430,.as described above, that is affixed to a mattress, as described above. In one embodiment, the pair of bladders 414, 414 is disposed on the floor. In another embodiment, the pair of bladders 414, 414 is disposed directly on a mattress. The user lies on mattress cover 430 in the supine position so that one of bladders 414, 414 is adjacent each side of the head, respectively, with the user's head between both bladders 414, 414, as demonstrated in FIG. 10. Pillow 426 is positioned on bladders 414, 414 and used to support the user's head. In one embodiment pillow 426 is omitted. When the user rolls from the supine to the side position, the head is positioned atop either of bladders 414, 414, so that it is elevated. The elevation may be adjusted by adding or expelling fluid to/from bladders 414, 414, respectively.

Although the present invention has been described with reference to various embodiments, workers skilled in the art will recognize that changes may be made in form and detail without departing from the spirit and scope of the invention.

It is hereby claimed:

1. A support for aligning a user's head and torso comprising:

at least one first bladder containing a fluid;

at least one second bladder containing a fluid that is communicatively coupled to the first bladder; and a means attached to at least one of the first and second bladders for attaching the first and second bladders to a surface;

wherein at least a portion of the fluid in the second bladder is displaced into the first bladder by a side of the user's torso when atop the second bladder, wherein the fluid displaced into the first bladder causes the first bladder to raise the user's head when a side of the user's head is atop the first bladder.

2. The support of claim 1, further comprising a duct that couples the first bladder to the second bladder.

3. The support of claim 2, further comprising a device that restricts fluid flow within the duct.

4. The support of claim 2, further comprising a valve adapted to close the duct, whereby isolating the first bladder from the second bladder.

5. The support of claim 1, wherein the first and second bladders are disposed on a mattress.

6. The support of claim 1, wherein the first bladder comprises first and second compartments.

7. The support of claim 6, wherein the first and second compartments are communicatively coupled.

8. The support of claim 7, further comprising a duct that couples the first compartment to the second compartment.

9. The support of claim 1, wherein the attachment means is adapted to selectively attach the first and second bladders to the surface, wherein the surface is a surface of a mattress.

10. The support of claim 1, wherein the attachment means is adapted to selectively attach the first and second bladders to the surface, wherein the surface is a surface of a mattress cover.

11. The support of claim 1, wherein the attachment means is adapted to fixedly attach the first and second bladders to the surface, wherein the surface is a surface of a mattress cover.

12. The support of claim 1, wherein the attachment means comprises a mattress cover having pockets, wherein the first and second bladders are sheathed in the pockets.

13. The support of claim 1, wherein a resilient material bears against the first bladder.

14. The support of claim 1 further comprising a duct adapted to inflate the first and second bladders.

15. A support for aligning a user's head and torso comprising:

at least one first bladder containing a fluid;

at least one second bladder containing a fluid:

a duct that couples the first bladder to the second bladder; and a means attached to at least one of the first and second bladders for attaching the first and second bladders to a surface;

wherein at least a portion of the fluid in the second bladder is displaced into the first bladder via the duct by a side of the user's torso when atop the second bladder, wherein the fluid displaced into the first bladder causes the first bladder to raise the user's head when a side of the user's head is atop the first bladder.

16. The system of claim 15 further comprising a device that restricts fluid flow within the duct.

17. A support for aligning a user's head and torso comprising:

at least one first bladder containing a fluid, wherein the first bladder comprises first and second compartments that are communicatively coupled;

at least one second bladder containing a fluid that is communicatively coupled to the first bladder; and a means attached to at least one of the first and second bladders for attaching the first and second bladders to a surface;

wherein at least a portion of the fluid in the second bladder is displaced into the first and second compartments of the first bladder by a side of the user's torso when atop the second bladder, wherein the fluid displaced into the first and second compartments of the first bladder causes the first bladder to raise the user's head when a side of the user's head is atop the first bladder so that the fluid displaced into the first and second compartments respectively support a chin and cranium of the user's head.

18. A support for aligning a user's head and torso comprising:

a pair of first bladders each containing a fluid;

a pair of second bladders each containing a fluid, one of the second bladders communicatively coupled to one of the first bladders forming one bladder system and the other second bladder communicatively coupled to the other first bladder forming another bladder system; and a means attached to each bladder system for attaching each bladder system to a surface;

wherein at least a portion of the fluid in the second bladder of either of the bladder systems is displaced into the first bladder of the respective system by a side of the user's torso when atop the second bladder of the respective system, wherein the fluid displaced into the first bladder of the respective system causes that first bladder to raise the user's head when a side of the user's head is atop that first bladder.

19. The support of claim 18, wherein the attachment means attached to each bladder system is adapted to selectively attach the respective bladder system to the surface, wherein the surface is a surface of a mattress.

20. The support of claim 18, wherein the attachment means attached to each bladder system is adapted to selectively attach the respective bladder system to the surface, wherein the surface is a surface of a mattress cover.

21. The support of claim 18, wherein each first bladder comprises first and second compartments.

22. The support of claim 18, further comprising a single duct coupled to each of the bladder systems adapted to simultaneously inflate the respective bladder systems.

23. The support of claim 18, further comprising a pair of ducts one duct coupling the first bladder to the second bladder of one bladder system and the other duct coupling the first bladder to the second bladder of the other bladder system.

24. The system of claim 23, further comprising a pair of devices, each restricting fluid flow within the respective ducts.

25. The support of claim 23, further comprising a pair of valves, each valve adapted to close each of the ducts, respectively, whereby isolating the first bladder from the second of the respective bladder systems.

26. A support for aligning a user's head and torso comprising:

a mattress cover:

a pair of pockets disposed on the mattress cover; and a pair of bladders each respectively sheathed within the pair of pockets, each bladder containing a fluid, wherein the bladders are disposed so that when the user is lying on either side and a side of the user's head is atop one of the bladders the fluid in that bladder elevates the head.

27. The support of claim 26, wherein each bladder includes two chambers that are communicatively coupled.

28. A support for aligning a user's head and torso comprising:

a pair of bladders, each bladder containing a fluid, each bladder including two chambers communicatively coupled and each chamber containing a portion of the fluid, wherein the bladders are disposed so that when a user is lying on either side and a side of the user's head is atop one of the bladders the fluid in that bladder elevates the head and the portion of the fluid in one chamber supports a cranium of the user's head and the portion of the fluid in the other chamber supports a chin of the user's head; and a means attached to each of the pair of bladders for attaching each of the bladders to a surface.

29. The support of claim 28, wherein the attachment means is adapted to selectively attach each of the pair of bladders to the surface, wherein the surface is a surface of a mattress.

30. The support of claim 28, wherein the attachment means is adapted to fixedly attach each of the pair of bladders to the surface, wherein the surface is a surface of a mattress.

31. The support of claim 28, wherein the attachment means is adapted to selectively attach each of the pair of bladders to the surface, wherein the surface is a surface of a mattress cover.

32. The support of claim 28, wherein the attachment means is adapted to fixedly attach each of the pair of bladders to the surface, wherein the surface is a surface of a mattress cover.

33. The support of claim 28, wherein a resilient material bears against the bladder.

34. The support of claim 28 further comprising a pair of ducts each adapted to inflate each of the pair of bladders, respectively.

35. The support of claim 28, further comprising a single duct coupled to each of the pair of bladders adapted to simultaneously inflate the respective bladders.

36. A support for aligning a user's head and torso comprising:

at least one bladder containing a fluid, wherein the bladder includes first and second compartments that are communicatively coupled, wherein at least a portion of the fluid in the second compartment is displaced into the first compartment by a side of the user's torso when atop the second compartment, wherein the fluid displaced into the first compartment causes the first compartment to raise the user's head when a side of the user's head is atop the first compartment; and a means attached to the bladder for attaching the bladder to a surface.

37. The support of claim 36, wherein the attachment means is adapted to selectively attach the bladder to the surface, wherein the surface is a surface of a mattress.

38. The support of claim 36, wherein the attachment means is adapted to fixedly attach the bladder to the surface, wherein the surface is a surface of a mattress.

39. The support of claim 36, wherein the attachment means is adapted to selectively attach the bladder to the surface, wherein the surface is a surface of a mattress cover.

40. The support of claim 36, wherein the attachment means is adapted to fixedly attach the bladder to the surface, wherein the surface is a surface of a mattress cover.

41. The support of claim 38, wherein a resilient material bears against the bladder.

42. The support of claim 36 further comprising a duct adapted to inflate the bladder.

43. A method for aligning a user's head and torso comprising:

disposing at least one bladder system on a surface, wherein the bladder system includes a first fluid containing bladder communicatively coupled to a second fluid containing bladder;

lying on the surface in a supine position adjacent the bladder system;

rolling from the supine to a side position, wherein the head is atop the first bladder and the torso is atop the second bladder, wherein the torso displaces at least a portion of the fluid from the second bladder into the first bladder, causing the first bladder to expand; and elevating the head using the expanding first bladder.

44. A method for aligning a user's head and torso comprising:

disposing a pair of bladder systems on a surface, wherein each bladder system includes a first fluid containing bladder communicatively coupled to a second fluid containing bladder;

lying on the surface in a supine position so that there is a first bladder adjacent each side of the head and a second bladder adjacent each side of the torso;

rolling from the supine to a side position, wherein the head is atop either of the first bladders and the torso is atop the respective second bladder, wherein the torso displaces at least a portion of the fluid from the respective second bladder into the respective first bladder, causing the respective first bladder to expand; and elevating the head using the respective expanding first bladder.

45. The method of claim 44, further comprising positioning the respective bladder systems so that in the supine position the user's head rests atop both of the first bladders simultaneously.

46. The method of claim 44, further comprising positioning the respective bladder systems so that in the supine position the user's head rests between the respective first bladders.

47. A method for aligning a user's head and torso comprising:

disposing a pair of fluid containing bladders on a surface, wherein each bladder includes a pair of communicatively coupled chambers;

lying on the surface in a supine position so that there is a bladder adjacent each side of the head;

rolling from the supine to a side position, wherein the head is atop either of the bladders so that the head is elevated and wherein a cranium and a chin of the user's head are supported by the pair of chambers, respectively, of the respective bladder.

48. The method of claim 47, further comprising adding fluid to the respective bladder to further elevate the head or expelling fluid from the respective bladder to reduce head elevation.

49. A method for aligning a user's head and torso comprising:

disposing at least one fluid-containing bladder on a surface, wherein the bladder includes first and second compartments that are communicatively coupled;

lying on the surface in a supine position adjacent the bladder;

rolling from the supine to a side position atop the bladder, wherein the torso displaces at least a portion of the fluid from the second compartment into the first compartment, causing the first compartment to expand; and elevating the head using the expanding first compartment.

* * * * *